US005489313A

United States Patent [19]

Hall et al.

[11] Patent Number: 5,489,313

[45] Date of Patent: Feb. 6, 1996

[54] METHOD FOR SALT-FREE DYEING

[75] Inventors: David M. Hall, Auburn, Ala.; Tony M. Leonard, Mountain, Ga.; Charles D. Cofield; Hugh W. Barrow, both of Dalton, Ga.

[73] Assignee: American Emulsions Inc., Dalton, Ga.

[21] Appl. No.: 238,211

[22] Filed: May 2, 1994

Related U.S. Application Data

[62] Division of Ser. No. 970,253, Dec. 15, 1992, Pat. No. 5,330,541.

[51] Int. Cl.[6] ..... D06P 3/60; C09B 67/00

[52] U.S. Cl. ..... 8/543; 8/576; 8/606

[58] Field of Search ..... 8/544, 537, 543, 8/576, 606

[56] References Cited

U.S. PATENT DOCUMENTS 3,652,201 3/1972 Bindler .
4,035,145 7/1977 Gipp et al. .
4,072,464 2/1978 Balland .
4,149,849 4/1979 Koch et al. .
4,615,709 10/1986 Nakao .

*Primary Examiner*—Johann Richter
*Assistant Examiner*—John Peabody
*Attorney, Agent, or Firm*—John Lezdey

[57] ABSTRACT

The invention relates to a process for increasing the dyeability of textile fibers and fabrics without the need to use a salt in the dyebath. The dyeing is performed on fibers or fabrics which have been treated with sodium hydroxide and an epoxy ammonium salt of the formula:

wherein R,R',R", and R"' are alkyl radicals having 1 to 8 carbon atoms, and $X^-$ is an anionic group selected from the group consisting of sulfate, sulfonate and halide.

6 Claims, 12 Drawing Sheets

500 X

1000 X

500 X

1000 X

4000 X

4000 X

500 X

1000 X

1000 X

4000 X

4000 X

METHOD FOR SALT-FREE DYEING

This is a divisional application of Ser. No. 07/970,253, filed Dec. 15, 1992, now U.S. Pat. No. 5,330,541.

FIELD OF THE INVENTION

The present invention relates to a process for improving the dyeability of textile fibers and fabrics without the use of salt. More particularly, there is provided a process for dyeing cellulosic fibers without the use of salt to increase the exhaust rate (speed of dyeing) through the use of an epoxy ammonium salt and a base which comprises potassium hydroxide or sodium hydroxide.

BACKGROUND OF THE INVENTION

Virtually all dyes that are classified as anionic in nature prior to the present invention require some levels of salt to influence the dyeing process.

Direct dyes are anionic normally because of sulfonic acid groups which impart water solubility. This class of dye is water soluble, but it also has great affinity for cellulose. The conventional method of application is to put the dye and the fiber (cotton, rayon etc), into a hot water bath, where the fiber swells, and then to add salt into the water to "salt" the dye out of solution. In this manner, the partitioning coefficients are changed to favor the partitioning in the fiber. Once inside the fiber, the temperature is reduced and the dye molecule is merely trapped inside the fiber, although some Van der Waal attraction between the dye and fiber does occur. There is no chemical bond between direct dye and the fiber aside from some weak hydrogen bonding.

Normally acid dyes are used for the dyeing of nylon or wool, defending upon an attachment with cationic amine groups inherent to those fibers. The molecules are much like those in direct dye, but the molecules are usually smaller. Acid dyes are applied in acid conditions at which the amine groups are protonated. Acid dyes are not normally used on cotton because of their size and the fact that the dye molecules can be removed from the fiber so easily after initial dyeing.

Vat dyes exist in two states, a water soluble form and an insoluble form. In use they are converted into the soluble form by reducing them, followed by application to the fiber. They must then be reoxidized. Reoxidation takes the dye to an insoluble state. Since the dye is now within the fiber, it can't be removed as long as it is insoluble thus this class of dye generally has outstanding wet fastness properties. The soluble form or "leuco" form as it is called, is anionic. Sulfur dyes are much like vat dye. They use a different kind of generic molecule having lower purity dyes with less brilliance than other classes. However, they are inexpensive. The sulfur dyes also have a leuco or reduced state which is anionic. It is made soluble prior to dyeing by reduction and insoluble by oxidation after dyeing similar to vat dye.

Fiber reactive dye actually react chemically with cellulose. They are anionic when in a water solution and therefore have affinity to polar fibers such as cellular, wool and the like. The application of this dye conventionally requires extremely high amounts of salt for salting the dye out of solution and into the fiber.

Depending upon the source of the information, direct dyes can be categorized by the way that salt is employed in the dyeing process. The Society of Dyers and Colorist classify dyes into three groups. Group A contain those dyes which have good migrating and leveling properties. Group B contain those dyes that have poor migrating or leveling properties but their dyeing can be controlled by the application of salt during the dyeing process. Group C dyes are those that have poor migrating properties but require good control of both dyeing temperature and salt additions.

Ciba-Geigy classifies Direct dyes into four broad groups according to their salt sensitivity and salt requirements.

Group 1 consists of those that will exhaust 50% or more in the absence of salt but will exhaust almost completely with 5–10 grams/liter (gpl) of salt. (Example—CI Direct Yellow 28)

Group II consists of those that will exhaust 20 to 30% in the absence of salt and progressively increase in exhaustion as the salt concentration is increased to 20 grams/liter. (Example—CI Direct Blue 71).

Group III consists of dye having very low substantivity without salt and only moderately increase their exhaust rate (speed of dyeing) with rising salt concentrations. (Example—CI Direct Green 27).

Group IV consists of dyes which are salt sensitive, (Example—CI Direct Yellow 37).

Crompton and Knowles also divides the dyeing with direct dyes according to salt sensitivity. Their classification: Group A Slow striking dyes requiring large levels of salt for complete exhaustion. Group B Medium striking dyes which require moderates amount of salt for complete exhaustion and Group C which are the rapid striking dyes which are salt sensitive and require little or no salt for light shades.

Salt sensitive dyes will tend to agglomerate excessively leading to poor crock fastness or other problems such as exhausting too quickly in the presence of even small amounts of salt.

It can easily be seen that dyestuffs having large differences in their dyeing behavior when using salt for exhaustion are to be avoided if possible when trying to combine dyes for purposes of matching a shade having the proper mixture of fastness properties. Thus there would be an advantage to the dyer if salt additions were net a factor to be considered in the dyeing process. Further, many more combinations of dyes that the dyer could now choose would be possible. Either common salt (NaCl), or Glauber's Salt($Na_2SO_4$) are the salt of choice for use in the dyeing process.

It is known to use an epoxy ammonium compound having the following formula:

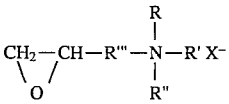

(I)

wherein R, R',R" and R"' are alkyl radicals having 1 to 8 carbon atoms, and X— is an anionic group such as the sulfate group, the sulfonate group or a halide group. The halides which may be used are fluoride, chloride, bromide or iodide.

The additive may be utilized in two distinct processes. The epoxy compound may be applied to the textile material within the dyeing bath or the printing pastes, i.e. in the presence of the dyestuff which is to be taken up by the textile material. Also, the fabric prior to carrying out the dyeing process can be treated with the epoxy compound.

It is known to fix the additive to cellulosic materials in the presence of an alkaline substance whose concentration increases inversely with the treatment temperature. In other words, higher concentrations of the alkali are necessary with lower temperatures, and higher temperatures are required when lower concentrations of the alkali are used. Generally, the alkali is a strong base, preferably caustic soda and extremely high concentrations are applied by the prior art to ensure fixation at low temperatures.

However, treatments at elevated temperatures have become preferable to lower temperature treatments utilized in the prior art because of faster processing and higher yields obtainable in industrial equipment.

It is known that treatment of the textile material at high temperature, after it has been impregnated with the epoxypropylammonium salt, gives rise invariably to a strong yellowing thereof. The yellowing may not be removed in the course of the usual treatments.

Such yellowing constitutes a considerable handicap to the use of the epoxypropylammonium salts at high temperatures.

The yellowing modifies or dulls the desired color when dyeing.

U.S. Pat. No. 3,685,953 to Cuvelier et al discloses a process of treating a hydrolyzed polymer such as cellulose with the epoxypropylammonium salt of the invention or the corresponding chlorohydrin and then drying at a high temperature to improve dyeing.

U.S. Pat. No. 3,853,460 to Balland relates to the use of alkylsulfosuccinates and alkylsulfosuccinates with the epoxypropylammonium salts to prevent hydrolysis of the compound to the dihydroxy compound.

U.S. Pat. No. 4,072,464 to Balland relates to the use of boric acid with the epoxypropylammonium salt to improve dye penetration of a cellulosic fabric and to decrease yellowing. The fabric is then heat treated at an elevated temperature.

U.S. Pat. No. 4,035,145 relates to the use of N-(2,3-epoxyalkyl) ammonium salts such as N-methyl-N-(2,3-epoxypropyl)-morpholinium chloride in the presence of alkaline compounds to improve the dyeability of cellulosic textiles.

U.S. Pat. No. 5,006,125 to Patton et al discloses the use of the epoxypropyl ammonium salt or the corresponding chlorohydrin to improve the bleaching process of cellulosic fabrics.

It is understood that the term "cellulosic fabrics" as used herein relates to natural and synthetic fabrics containing free hydroxyl groups which include cotton, flax, linen, rayon, and the like. This process is also useful on other polyhydroxyl polymers such as polyvinyl alcohol.

The term "fabric" as used herein refers to yarns, tows, mats, bathings, cloth, and the like which constitute similar fibers or blends with other natural or synthetic fibers such as wool, polyester, nylon, etc.

It is understood that the term "salt" which Is used herein refers to inorganic salts such as NaCl and $Na_2SO_4$ which are used in a dyeing process to increase the speed of the dyeing process.

SUMMARY OF THE INVENTION

The present invention provides a process for dyeing fibers or fabrics without utilizing a salt as the dyebath exhausting agent. According to the process the fibers or fabrics are treated with a dilute solution of potassium hydroxide, a dilute solution of an epoxy ammonium compound of the formula:

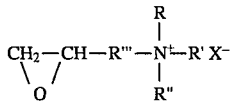

(I)

wherein R,R',R" and R"' are alkyl radicals having 1 to 8 carbon atoms, and $X^-$ is an anionic group selected from the group consisting of sulfate, sulfonate and halide, and dyeing the fibers or fabrics in a dyebath without salt and at a temperature below 200° F.

Preferably the epoxy ammonium compound is present in an amount of about 2 to 15% by weight and the potassium is present in the amount of about 0.5 to 10% by weight.

The process provides an improvement in dyeing when utilizing a direct dye, an acid dye or fiber reactive dye.

The process can also be performed with sodium hydroxide in lieu of some or all of the potassium hydroxide. However, the wash fasteners and/or wetfastness of the finished product is not as good.

Other aspects, objects and advantages of the invention will be more fully appreciated with reference to the drawings and the following description.

DESCRIPTION OF THE PREFERRED EMBODIMENT

Figure 1:
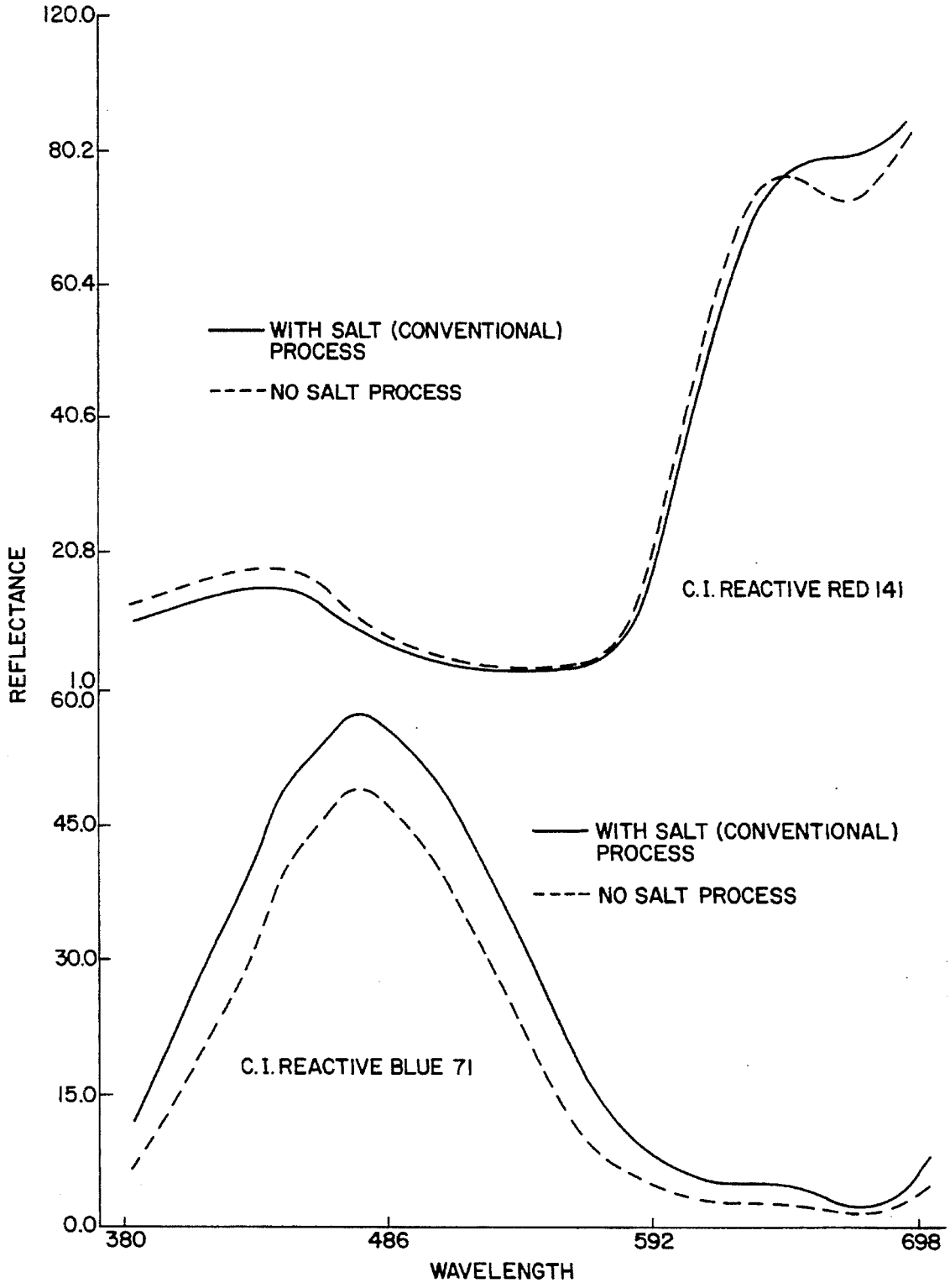
FIGS. 1–4 are spectrophotometric measurements reflectance comprising finished fabrics of the invention with the conventional process utilizing different dyes.

Although specific terms are used in the following description for the sake of clarity, these terms are intended to refer only to the particular feature selected for illustration, and are not intended to define or limit the scope of the invention.

The objects and advantages of the present invention are obtained by the treatment of textile fabrics, especially those comprising cellulosic fibers, with potassium hydroxide and an epoxy ammonium salt of the formula:

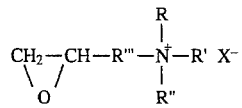

(I)

wherein R,R',R" and R"' are alkyl radicals each independently having 1 to 8 carbon atoms, and $X^-$ is an anion selected from the group consisting of sulfate, sulfonate and halide. R,R'and R" are preferably lower alkyl but can be the higher alkyl groups, while R"' is advantageously a lower alkyl group, that is, eight or less carbon atoms, and most preferably R"' is methylene, and dyeing the fabric without utilizing a salt in the dyebath at a temperature below 200° F.

Representative of the preferred compounds of the invention are epoxypropyl trimethyl ammonium chloride, epoxypropyl diethylmethyl ammonium sulfate, epoxypropyl dimethyl ethyl ammonium iodide.

The amount of potassium hydroxide which is utilized is about 0.5 to 10% on weight fabric (OWF). The potassium hydroxide is preferably added to a bath at a temperature of 100° F. or below with a water ratio of liquor to goods being 5–15 to 1, preferably 10 to 1. The potassium hydroxide treatment of the fibers or fabrics can be prior to treatment with the epoxy ammonium compound or it can be done simultaneously.

After treatment with the epoxy ammonium compound the bath is slowly raised to an elevated temperature, advantageously at a rate of 3° F./min, but not greater than 200° F. to avoid yellowing. A temperature of about 160° F. has been found to be suitable to fix the epoxy ammonium compound to the fibers or fabrics before dyeing.

The dyeing of the fibers or fabrics can then take place as is customary except that salt or driving agents are not necessary. However, levelling agents, sequestering agents and other dyeing aids as conventionally utilized can be added to the various baths.

The process of the invention has been found to be particular advantageous when utilizing direct dyes. The present process has eliminated the need for salt rinsing and environmental concerns relating to the discharge of large quantities of brackish water. The process further provides improved wash fastness, levelling and wetfastness without the need for conventional aftertreatment.

The present process further improves the dyeing with reactive dyes. There has been most advantageous results with reactive dyes which have an affinity to the epoxy ammonium compound. As a result of the pretreatment with potassium hydroxide and the epoxy ammonium compound, a lower amount of the reactive dye is needed and the dyeing time has been reduced. It has been found in some cases that the dye process time has been reduced from 3 to 6 hours to about 2.5 to 3 hours.

It has also been found that in lieu of potassium hydroxide, sodium hydroxide can also be used. However, the results with sodium hydroxide are not as good. The addition of potassium hydroxide improves the wash fastness and wetfastness of the dyed goods as a result in fiber crystallinity. The dyeing of the goods after treatment with sodium hydroxide in lieu of potassium hydroxide is only satisfactory and the best results are found with a black dye.

Sodium Hydroxide (NaOH) is normally used in textile processes instead of the more expensive potash caustic (KOH) form. There are also several other practical reasons. The reactions of these two alkali hydroxides with the cellulose polymer are totally different; however, all of the alkali metal hydroxides causes considerable irreversible swelling of the cellulose molecular structure.

Alkali swelling of cellulose can be explained by the difference in hydration of the alkali ions employed. At endless dilution, a gram-ion of lithium binds 120 moles of water while a gram ion of sodium, 66, a gram ion of potassium 16 and that of rubidium 14 and cesium 13. That is, potassium hydroxide has only about a ¼ the of the swelling capacity of sodium hydroxide at complete mercerization. Since the ability of the alkali metal ion to hydrate effects the swelling of the cellulose, the diameter of the fiber (or swelling capacity at complete mercerization) will differ with the alkali metal employed. Table 1 shows the effects of the different kind of alkali metal hydroxides on the swelling capacity of the cotton fiber.

TABLE 1

Effect of Different Kinds of Alkali Metal Hydroxides on the Swelling of Cotton Fibre

| | Concentration of alkali at which maximum swelling is observed | | Increase in fibre diameter |
|---|---|---|---|
| Reagent | g/100 g solution | mol/l | % |
| LiOH | 9.5 | 4.0 | 97.0 |
| NaOH | 18.0 | 4.5 | 78.0 |
| KOH | 32.0 | 5.8 | 64.0 |
| RbOH | 38.0 | 3.8 | 53.0 |
| CsOH | 40.0 | 2.7 | 47.0 |

Thus the potassium hydroxide may not cause the drastic swelling of the cellulose substrate, caused by sodium hydroxide, which could result in wasted reactions within the highly swollen structure produced by the sodium alkali but yet, still allow for effective dye penetration of the swollen pores produced at the fiber surfaces. At complete mercerization (loss of crystalline structure), the dye ability of fibers mercerizod by KOH is 50% lower than that produced by NaOH. Less than mercerizing strength alkali is being used in the reactions of the epoxypropylammonium chloride. The alkali is necessary for both the swelling of the cellulose and the reaction of the reagent with the swollen cellulose substrate.

Figure 5:
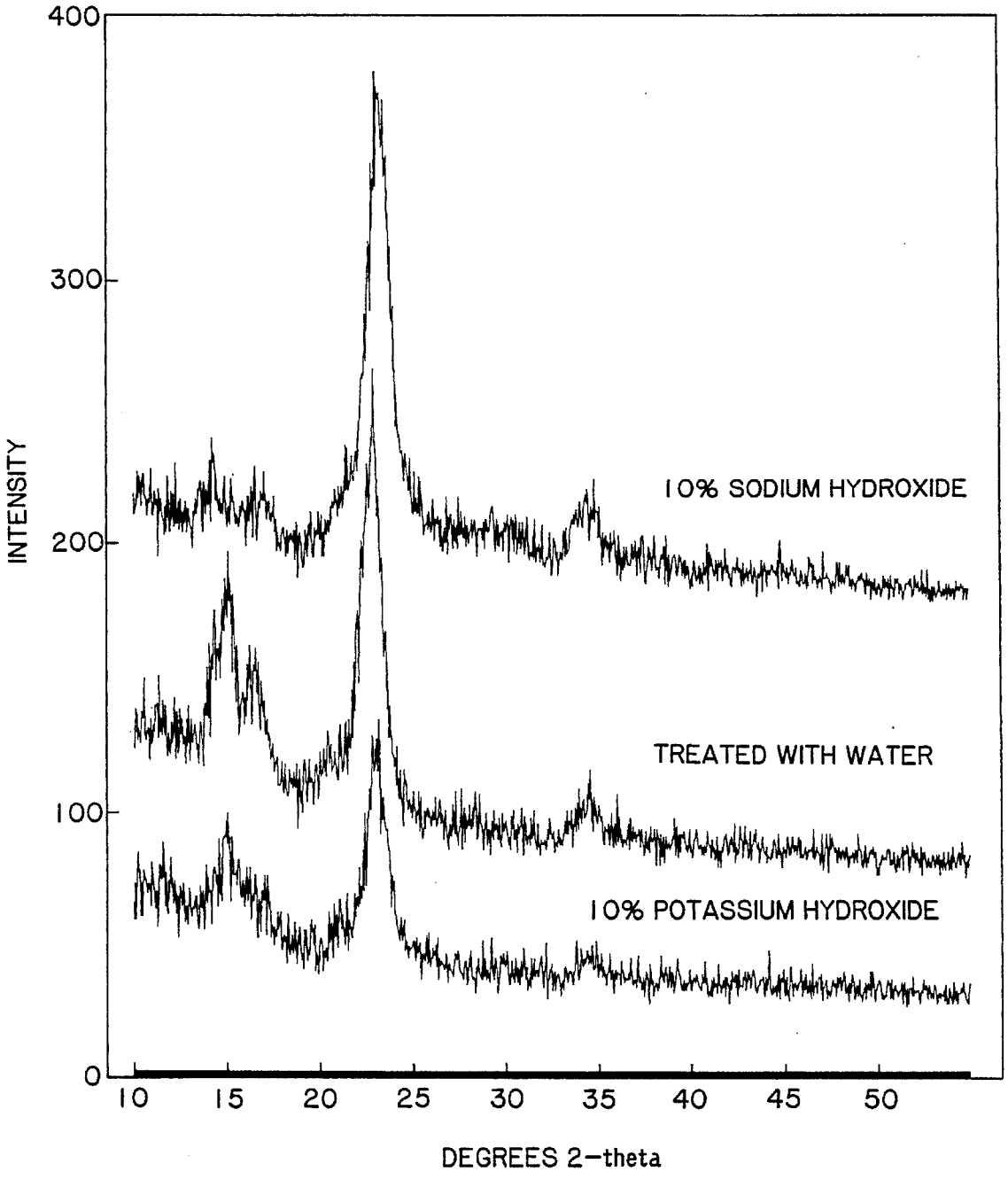
FIG. 5 shows a comparison of the X-ray diffraction analysis of cotton fibers after treatment with sodium hydroxide and potassium hydroxide.
Figure 6:
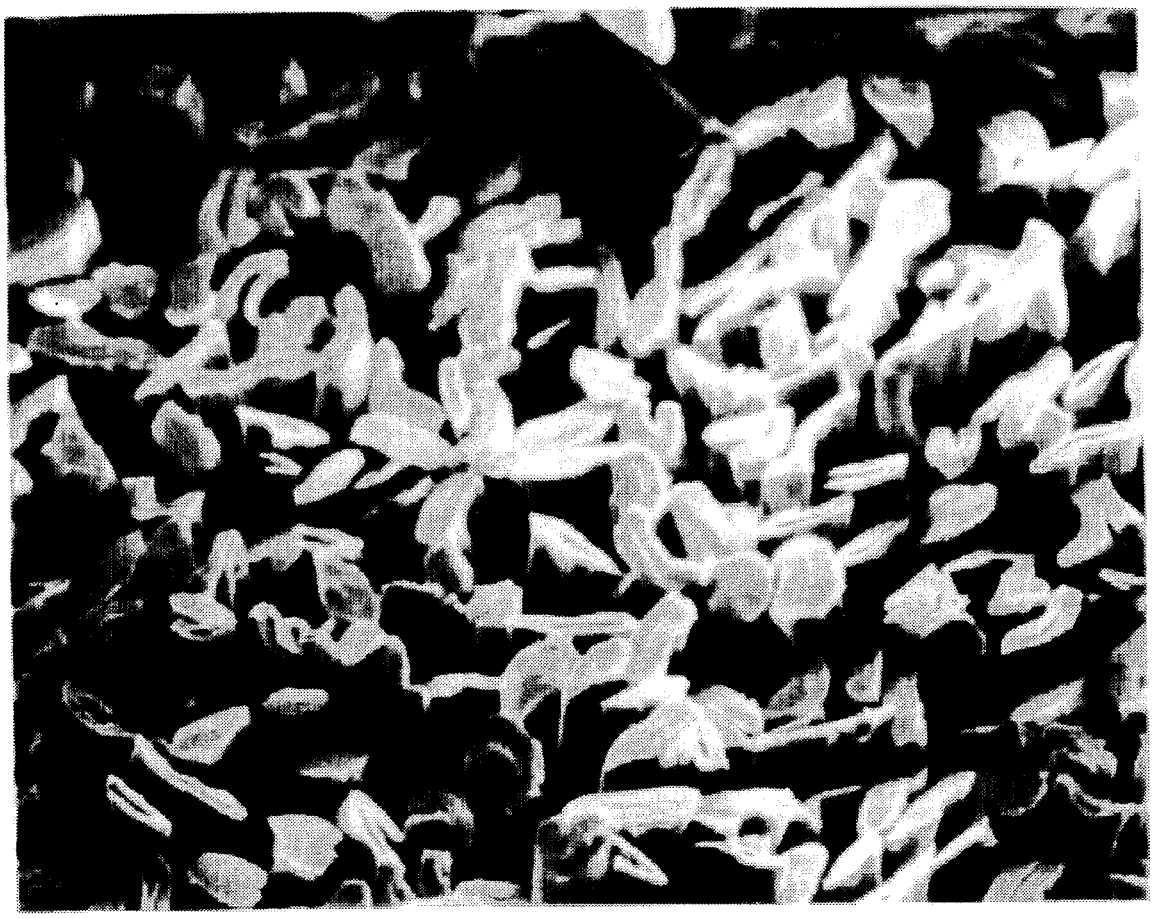
FIG. 6 is a photomicrograph of cotton fibers swollen with water at 500× magnification.
Figure 7A:
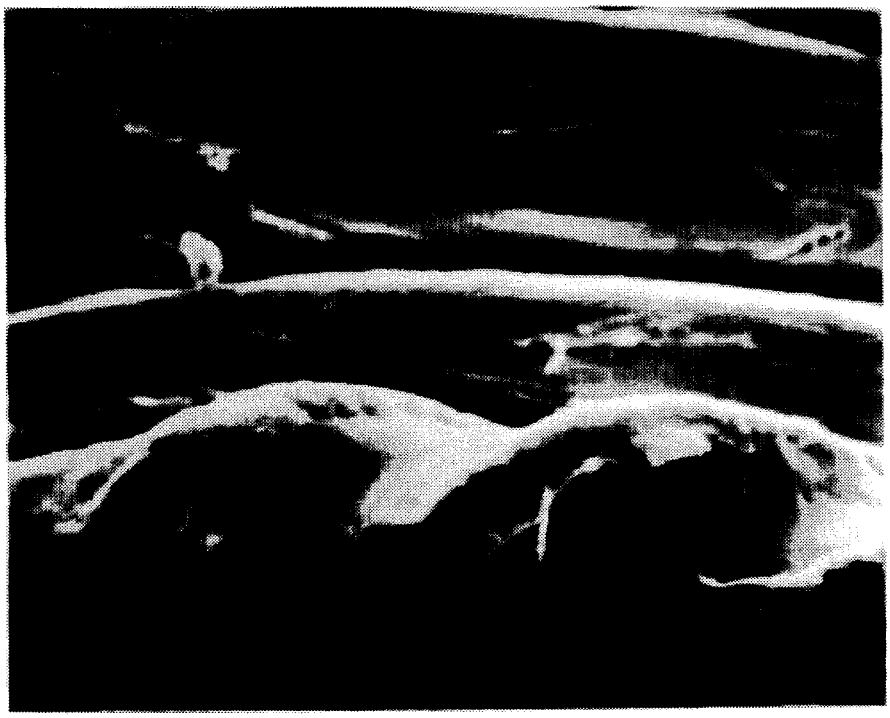
FIG. 7A and 7B are photomicrographs of the fibers of FIG. 6 at 1000× magnification.
Figure 7B:
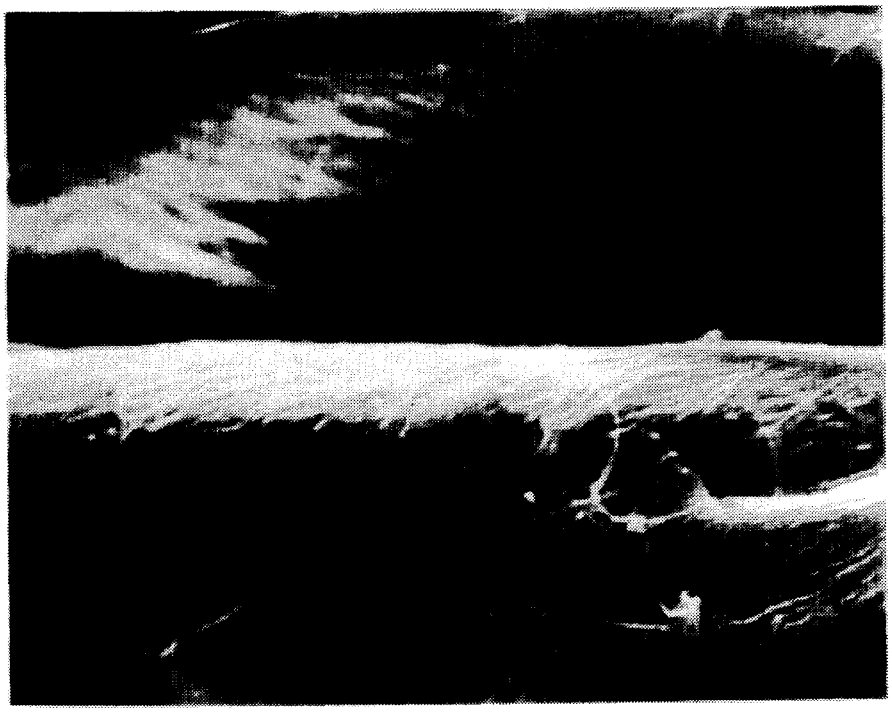
Figure 8A:
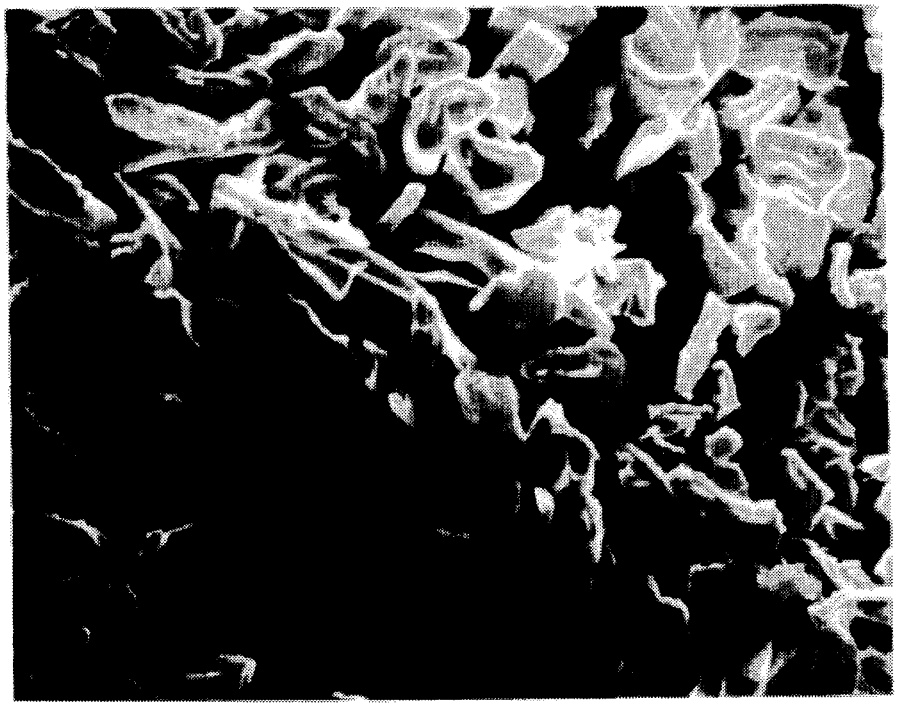
FIG. 8A is a photomicrograph of cotton fibers swollen with 10% potassium hydroxide solution at 500× magnification.
Figure 8B:
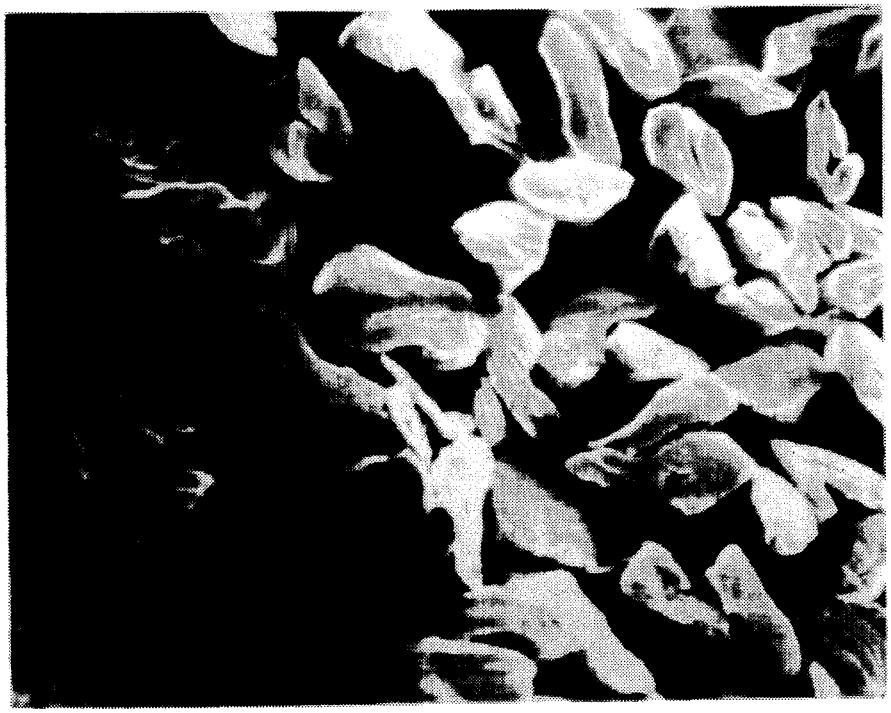
FIG. 8B is a photomicrograph of the fibers of FIG. 8A at 1000× magnification.
Figure 8C:
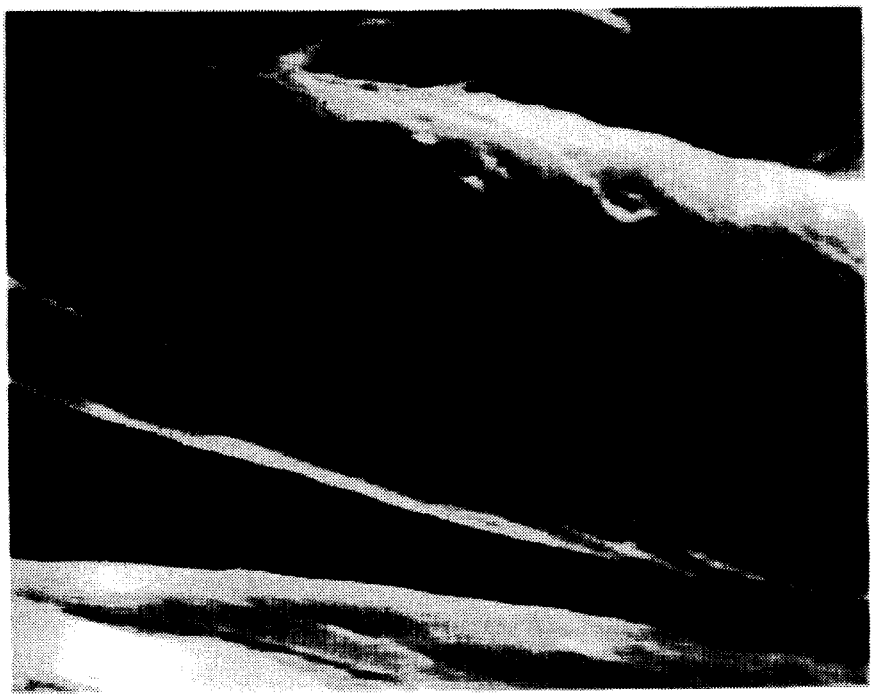
FIGS. 8C and 8D are photomicrographs of the fibers of FIG. 8A at 4000 × magnification.
Figure 8D:
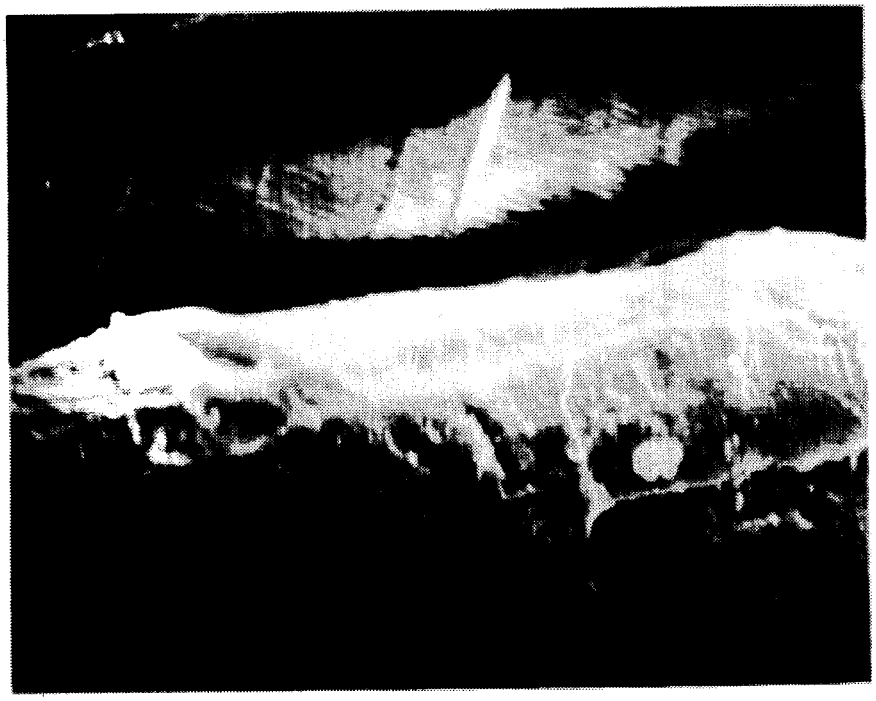
Figure 9A:
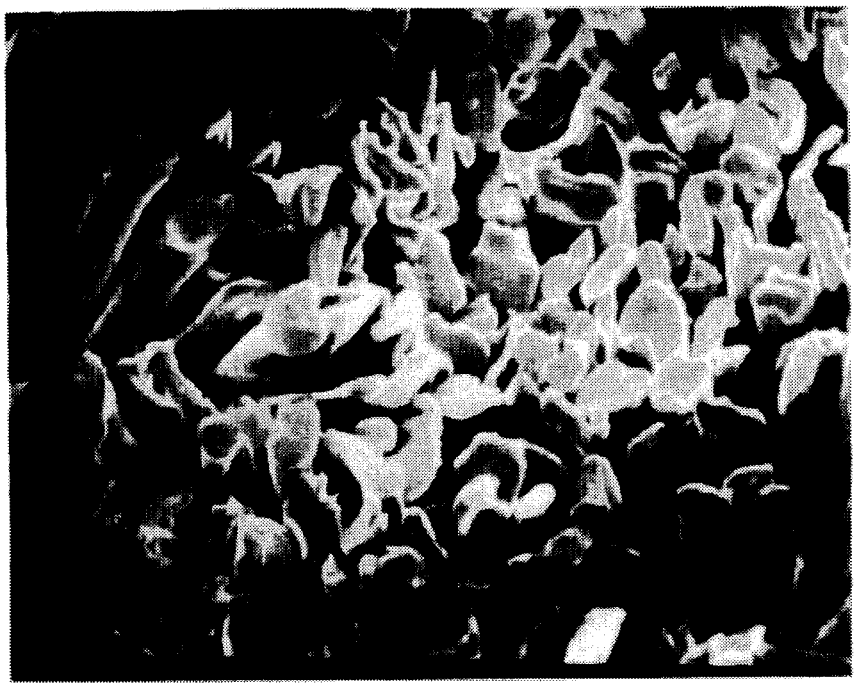
FIG. 9A is a photomicrograph of cotton fibers swollen with 10% sodium solution at 500× magnification.
Figure 9B:
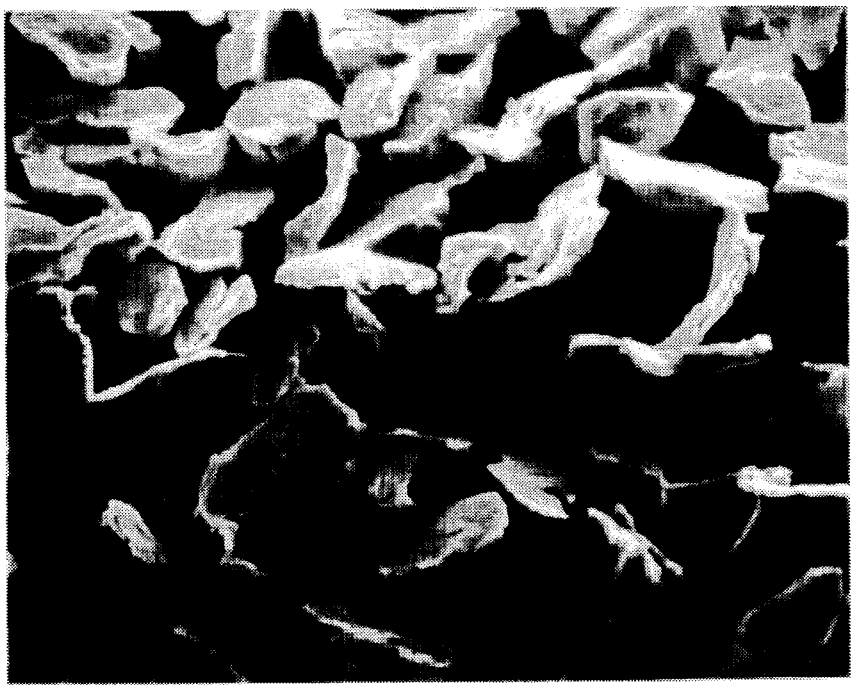
FIGS. 9B and 9C are photomicrographs of the fibers of FIG. 9A at 1000× magnification.
Figure 9C:
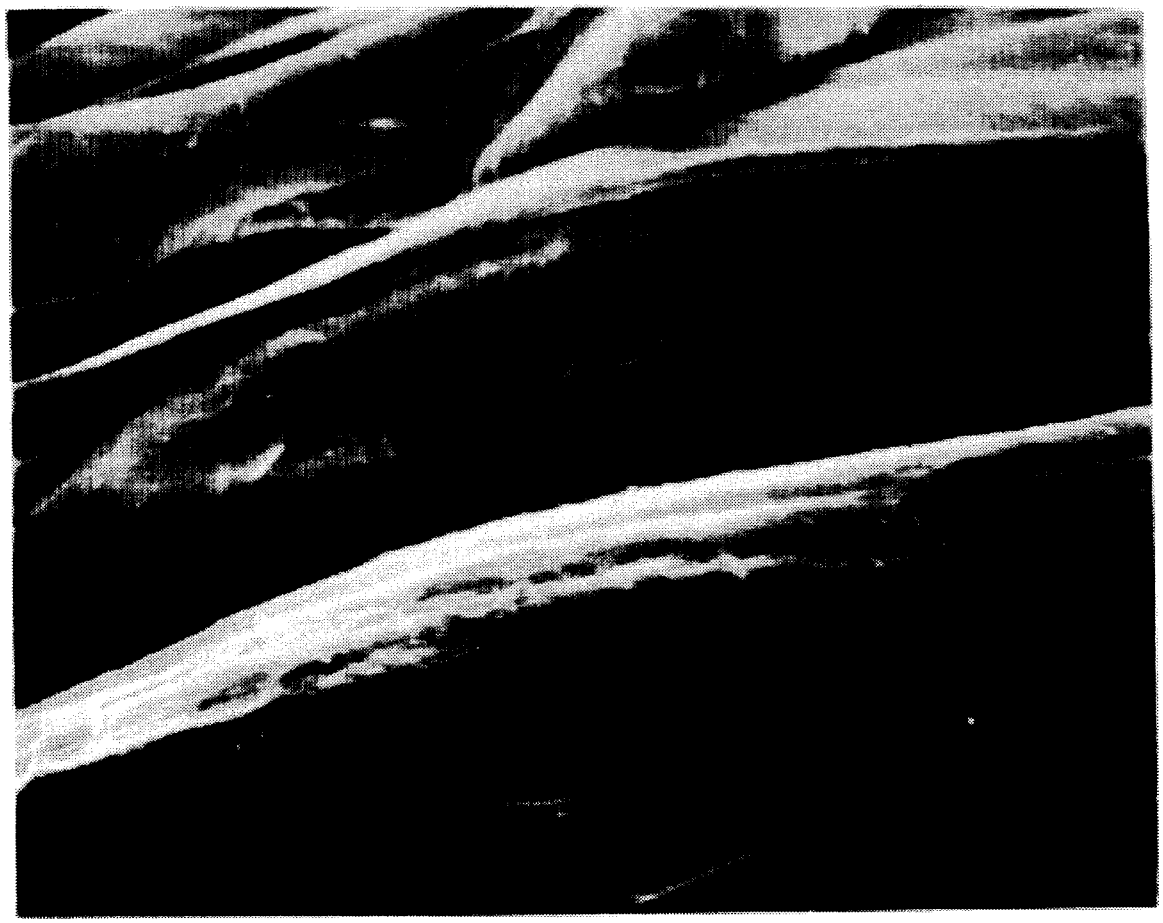
Figure 9D:
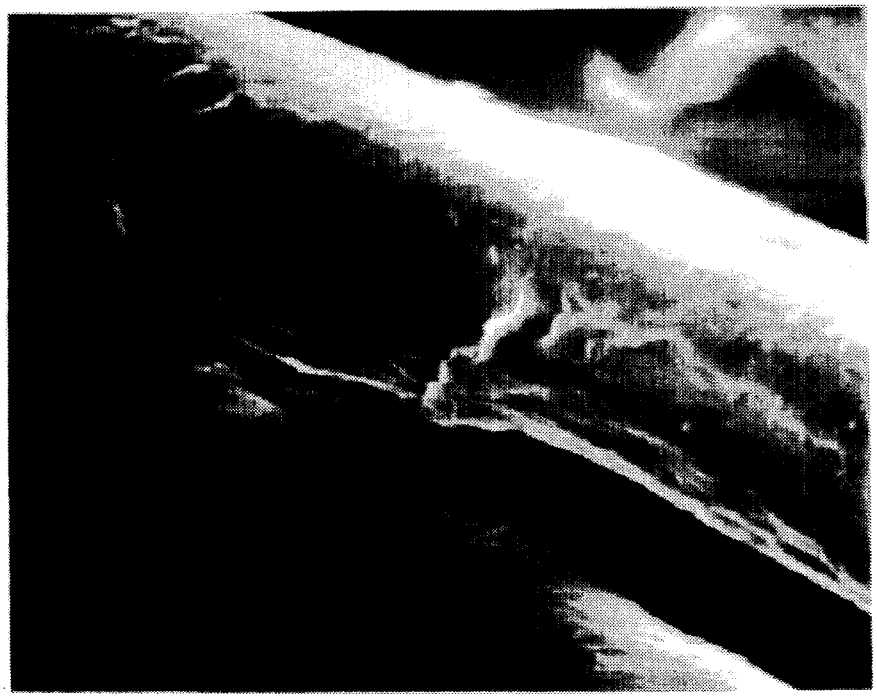
FIGS. 9D and 9E are photomicrographs of the fibers of the FIG. 9A at 4000× magnification.
Figure 9E:
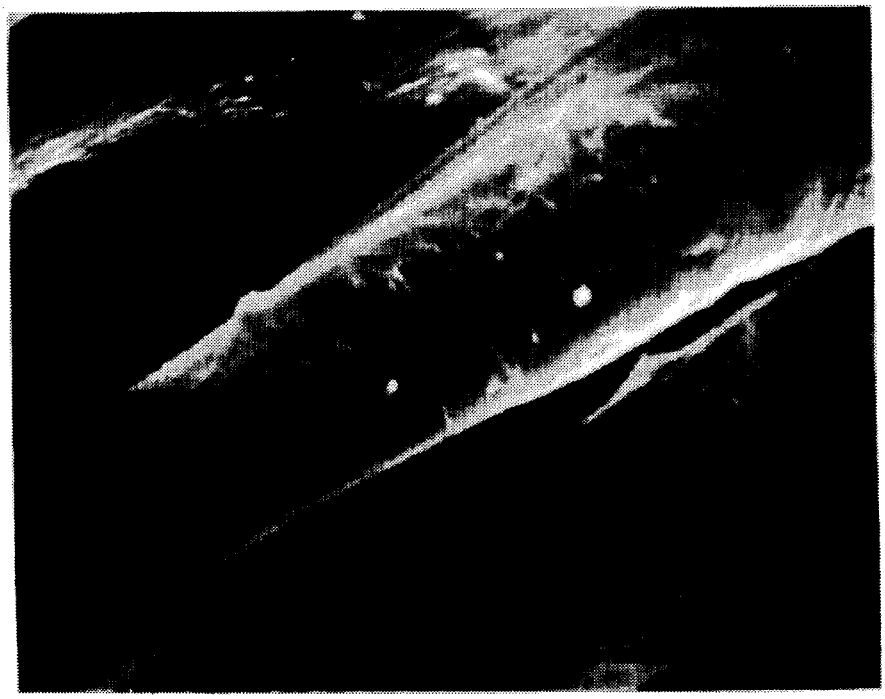

As illustrated in FIG. 5, even after treatment in hot water the cotton fiber exhibits a high crystalline characteristic. Very little of the crystallinity of the fiber is lost after treatment with a 10% sodium hydroxide.

The major effect seems to be in the plane atoms affecting the diffraction peaks at 15°2 theta. There is only a slight loss of resolution in the diffraction peak at 23°2 theta representing the 110 plane of atoms along the fiber axis. With the 10% potassium hydroxide there is a greater loss in the fiber crystallinity represented by the lower peak height to base line ratio for the diffraction peak at 23°2 theta. Also the crystalline regions given by the diffraction peak at 15°2 theta is affected but not to the extent as that obtained in the sodium treatment. Further the diffraction peak at about 35°2 theta has virtually disappeared in the potassium treated cotton.

In the reaction of the cellulose with epoxypropylammonium chloride using the sodium hydroxide, the color yields and brightness of the dyeing seem to be impaired but, is improved when potassium hydroxide is being employed. The purpose of swelling the cellulose is to improve the speed of entry of the dyes as well as provide for an increase in the Van Der Wall type attractions that affect the affinity between the dye and the cellulose molecule.

Attachment of epoxypropylammonium chloride groups to the cellulose chains, provide positively charged ammonium sites for attachment of a dye molecule to the cellulose fiber through salt charged groups like linkages (primary bonds) between the sulfonic acid group and/or similar dye molecule and the pendant ammonium groups. This replaces the formerly weak secondary bonding forces responsible for the dye "affinity" and which were promoted by total mercerization of the cotton. Thus a "site" mechanism for dyeing will now be operative and may not be dependent upon a highly swollen substrate that may actually be counter productive to improved dye ability.

Another factor promoting rapid dyeing is the fact that the ammonium group has a strong positive charge and thus neutralizes the negative charge on the fiber surface which acts as a barrier to the absorption of the negatively charged (anionic) dye. Thus the salt that was needed to obtain the necessary neutralization of the fiber surface charge and obtain a faster dyeing rate is no longer required.

There is also a measurable improvement in the brightness of the dyed fabrics. Since brightness has a great deal to do with the smoothness and topography of the fiber surface as well as the fiber crystallinity, these parameters were studied for fabrics which had been prepared by using both the sodium and potassium hydroxides for the reaction between cellulose and the epoxypropylammonium chloride reagent.

FIGS. 6–9E show the surface topography and fiber swelling characteristics as seen with Scanning Electron Microscopy with water, 10% sodium hydroxide solution and 10% potassium hydroxide solution. FIGS. 6–9E show that the 10% sodium and potassium hydroxide solutions swell the fibers to approximately the same extent. Also, the smoothness and surface topography of the fibers appears to be the same when treated either with sodium hydroxide or potassium hydroxide solution. The increased smoothness resulting from the swelling will result in greater brightness for the dyed fibers.

There is a considerable difference in the crystalline structure that can be produced by the choice of the alkali metal ion utilized for the reactions with the cellulose. If sodium alkali is used, the fiber undergoes swelling but there is not much loss in the overall crystalline structure of the cellulose substrate. The sodium alkali appears to influence that portion of the cellulose represented by the plane of atoms responsible for the diffraction peak at 15°2 theta more than the potassium. The potassium alkali causes a greater affect on the 110 plane represented by the diffraction peak at 23°2 theta. This may be brought about by the fact that the potassium ion is about a third larger than the sodium ion (ionic radium of sodium=0.98 angstroms, for potassium=1.33 angstroms). Thus even though 10% potassium hydroxide will not contain as many ions as 10% sodium hydroxide, the larger ion may cause greater swelling and disruption of the cellulose crystals. The result will be a more uniform distribution of the epoxypropylammonium chloride moleties along the cellulose chain structure providing for sites that will be more accessible to even large dye molecules. More rapid and uniform (level) dyeings will occur that can influence the brightness of the dye fiber.

Thus even though both the sodium and potassium hydroxides will work to give the desired no salt dyeings, they will differ in their effect on the reaction with the cellulose substrate and, result in differences in their dyeing and fastness properties. The improved dyeing properties obtained when using the potassium hydroxide for the cellulose reactions calls for its use as the preferred embodiment when practing the present invention.

The process of the invention can be used in a two bath system or a single bath system. Either method provides good color yield. However, the two bath system has the advantage of resulting in better wetfashness.

The present invention will now be explained in detail by reference to the following non-limiting examples. Unless otherwise indicated, all percentage are by weight.

EXAMPLE 1

A. Pretreatment 25 g of cotton fabric was scoured in an aqueous bath containing 1% OWF of a nonionic surfactant (Wilwet CFX) and 2% OWF of sodium carbonate at a temperature between 160°–180° F. for about 20 minutes. The bath was drained and the fabric was rinsed with cold water.

B. Conditioning

The fabric from part A was placed in an aqueous bath at 90° F. having a water volume of 10 to 1. 10% OWF of epoxypropyl trimethyl ammonium chloride (WILDYE PTC) was added to the bath and circulated for 10 minutes. 10% of potassium hydroxides in a 45% solution was added to the bath and the temperature was raised to 160° F. at a rate of rise of 3° F./min. The bath temperature was maintained for 30 minutes. The liquid was drained and the fabric was rinsed with water at 60° F. A fresh bath was prepared and the pH of the goods was adjusted with acetic acid to a pH below 6.5. The bath was then drained.

C. Dyeing With Direct Dye

A dyebath was prepared with a liquid to fabric ratio of 10 to 1 at a temperature of 90° F.C. To the bath was added a sequestering agent 0.5% (SELECTQUEST) , 1.0% of levelling agent (WIL-LEVE 60 N) and 2.0% of a nonionic lubricating agent (WILOLUBE) . The bath was mixed for 5 minutes and 5% of predissolved direct dye was added. The fabric from part B was added and the bath was circulated for 10 minutes. The bath temperature was raised to 180° F. at a rate of 3° F./minutes and maintained for 45 minutes. The dyebath was drained and the fabric was rinsed with warm water 120° F.) for 10 minutes, drained and rinsed with hot water (140° F.). 1% of WILWET CFX was added and the fabric was washed to remove any unfixed dye. The fabric was then rinsed with water at 100° F. extracted and dried

EXAMPLE 2

Dyeing With Reactive Dye

Following the procedure of Example 1, cotton geige goods were pretreated and then conditioned. The cotton goods were then placed in a dyebath at 100° F. with a liquor to goods ratio of between 5 to 15 to 1. About 1% of predissolved reactive dye was slowly added and the bath was circulated for 10 minutes. The temperature of the dyebath was raised to 180° F. at a ratio of 3° F./minutes. The dyeing was continued at this temperature for 30–45 minutes. The dyebath was drained, rinsed with warm water (120° F.) for 5 minutes and then a fresh bath of hot water (160° F.) was added with 1% of WILWET CFX. The cotton goods merely washed for 15–20 minutes to remove untreated dye. The bath was drained, rinsed with cold water, extracted and then dried.

EXAMPLE 3

A. Pad Batch Dyeing

A cotton knit fabric was padded at room temperature with a solution containing 20 g/l of epoxypropyl trimethyl ammonium chloride, 20 g/l of potassium hydroxide, 2 g/l WILWET CFX and 17 g/l of direct Black 22 dye. The percent wet pick up was calculated to be 120% increase. The goods were stored for 8 hours at room temperature. The goods were then rinsed with water containing 1% WILWET CFX at a temperature of 140° F. for 15 minutes.

The goods exhibited good level color yield, very little wash off and good washfastners.

B. Comparison Pad Batch Dyeing

The procedure of part A was followed except that 20 g/l sodium hydroxide was used in lieu potassium hydroxide.

The goods had a high wash off and exhibited poor level color.

EXAMPLE 4

A. One Bath Pretreat Dye Method

Cotton yarn was prewet for 10 minutes at 100° F. in a package dye machine with 0.5% WILWET CFX. The liquor to goods ratio was set at 10 to 1. The bath temperature was set at 100° F. 10% OWF of epoxypropyl trimethyl ammonium chloride was added and the mixture stirred for 10 minutes. 10% potassium hydroxide was added and the bath was circulated for 15 minutes. 3% of predissolved Direct Black Dye 22 was slowly added to the bath. The temperature of the bath was raised to 160° F. at a rate of 3° F./minutes. The bath was circulated for 30 minutes and the temperature was raised to 180° F. and held for 15 minutes. The bath was drained and a fresh bath was added with water temperature at 140° F. Acetic acid was added to lower the pH to 6.5. 0.5% WILWET CFX was added and the bath was circulated to remove unfixed dye. The bath was then drained and the fabric rinsed with cold water.

The resulting fabric showed satisfactory wetfastness but was not as good as Example 1.

B. Comparison With Sodium Hydroxide

The one bath dyeing method of part A was rerun except that 10% sodium hydroxide was utilized in lieu of potassium hydroxide.

The resulting fabric showed poor wetfashness and poor leveling.

EXAMPLE 5

Following the procedure of Example 1, a series of runs were performed to determine the wetfastness of different direct dyes as determined by the test methods of AATCC wherein the rating 1 is poor and 5 is best. The results were as follows:

| Run | Dye- C.I. Number | % Dyeing | Wetfastness Rating |
|---|---|---|---|
| 1 | Direct Yellow 96 | 2% | 5 |
| 2 | Direct Yellow 106 | 1% | 5 |
| 3 | Direct Yellow 86 | 1% | 5 |
| 4 | Direct Orange 39 | 1% | 4 |
| 5 | Direct Red 9 | 0.5% | 5 |
| 6 | Direct Red 80 | 1% | 5 |
| 7 | Direct Red 83 | 1% | 5 |
| 8 | Direct Red 72 | 2.5% | 3 |
| 9 | Direct Violet | 2% | 5 |
| 10 | Direct Blue 80 | 2% | 4 |
| 11 | Direct Blue 218 | 3% | 4 |
| 12 | Direct Blue 108 | 1.5% | 4 |
| 13 | Direct Blue 200 | 1.5% | 3 |
| 14 | Direct Black 22 | 3% | 4 |

EXAMPLE 6

Following the procedure of Example 1, a series of runs were performed to determine the wetfastness of different reactive dyes as determined by the test methods of ATCC wherein the rating 1 is poor and 5 is best. The results are as follows:

| Run | Dye- C.I. Number | % Dyeing | Wetfastness Rating |
|---|---|---|---|
| 1 | Reactive Yellow 84 | 2% | 5 |
| 2 | Reactive Orange 84 | 2% | 5 |
| 3 | Reactive Red 141 | 2% | 4–5 |
| 4 | Reactive Red 120 | 2% | 5 |
| 5 | Reactive Blue 160 | 2% | 6 |
| 6 | Reactive Blue 187 | 2% | 5 |
| 7 | Reactive Blue 171 | 2% | 4 |
| 8 | Reactive Blue 71 | 2% | 4 |
| 9 | Reactive Blue 19 | 2% | 4 |

EXAMPLE 7

Figure 2:
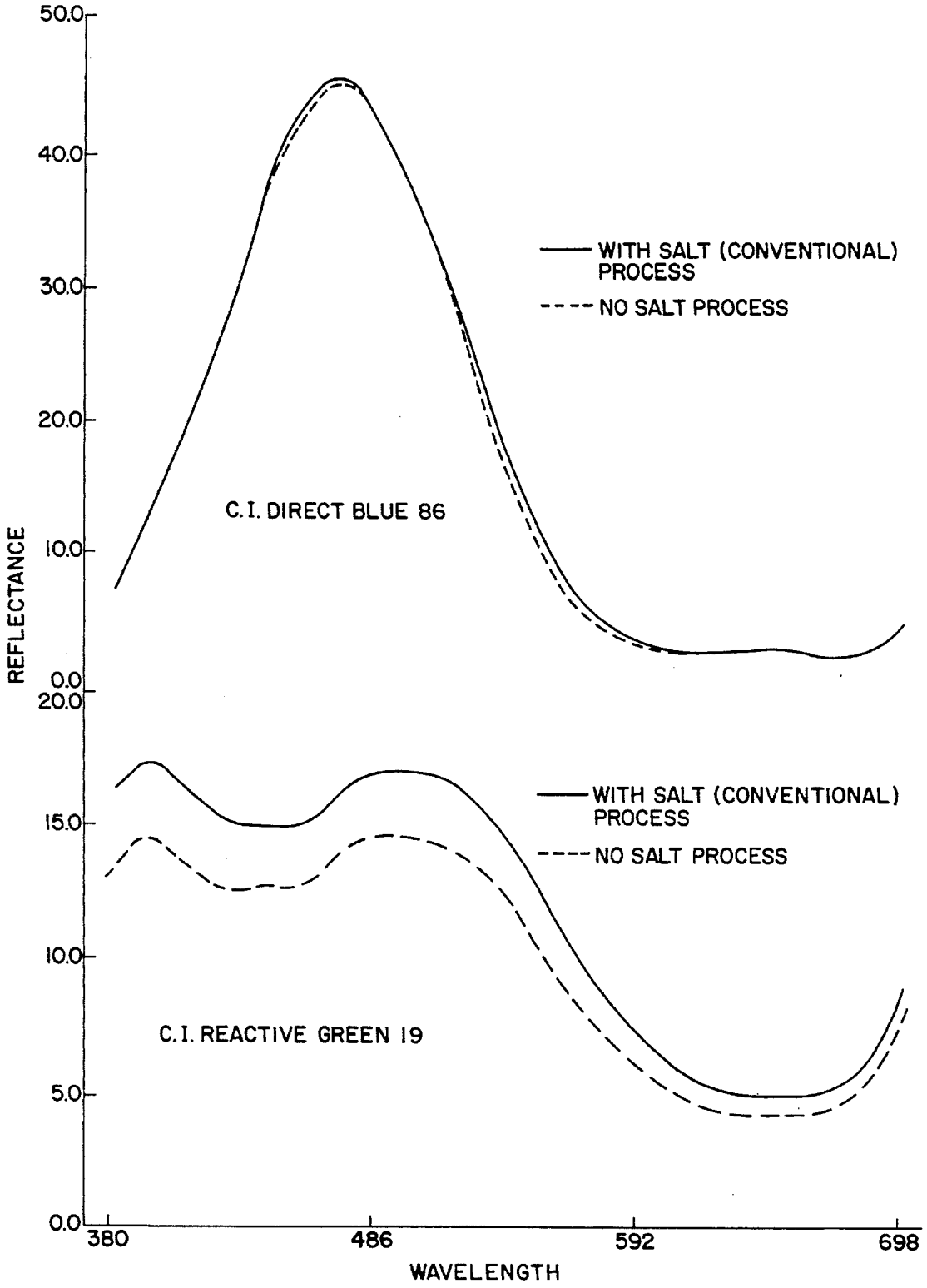

Dyeings were made on 100% cotton knit goods with several fiber reactive and direct dyes to compare the color yield when dyed by the dye manufacturers recommended procedures compared to the no salt process of example 1 and no salt or alkali process of example 2. The dyes selected were C.I. Direct Blue 86, (2% dying and 40% salt owf On Weight of Fabric). C.I. Reactive Green 19, (1.5% dye and 125% salt owf) C.I. Reactive Blue 71 (2.0% dye and 125% salt owf) and C.I. Reactive Red 141 (2.5% dye and 125% owf salt) . Spectrophotometric measurements of reflectance were made on the finished fabrics and are illustrated in FIGS. 1–2. In every case, the dyeings were equal to the conventional process (Direct Blue 86 and Reactive Red 141) or were significantly higher in their color yield (Reactive Blue 71 and Reactive Green 19). In every case the dyeing using the process of examples 1–2 showed an increase in brightness. Because of the brightness, the dyeings appeared to have achieved greater yields even though the reflectance curves show about equal dye content in the fabrics. The Reactive Blue 71 appeared about twice as strong as the conventional while the reactive Green appeared about 50% stronger in shade than the conventional dyeings.

The Direct Blue appeared distinctly brighter and about 50% stronger in shade even though the spectral curves show essentially equal color on the fabrics.

EXAMPLE 8

Figure 3:
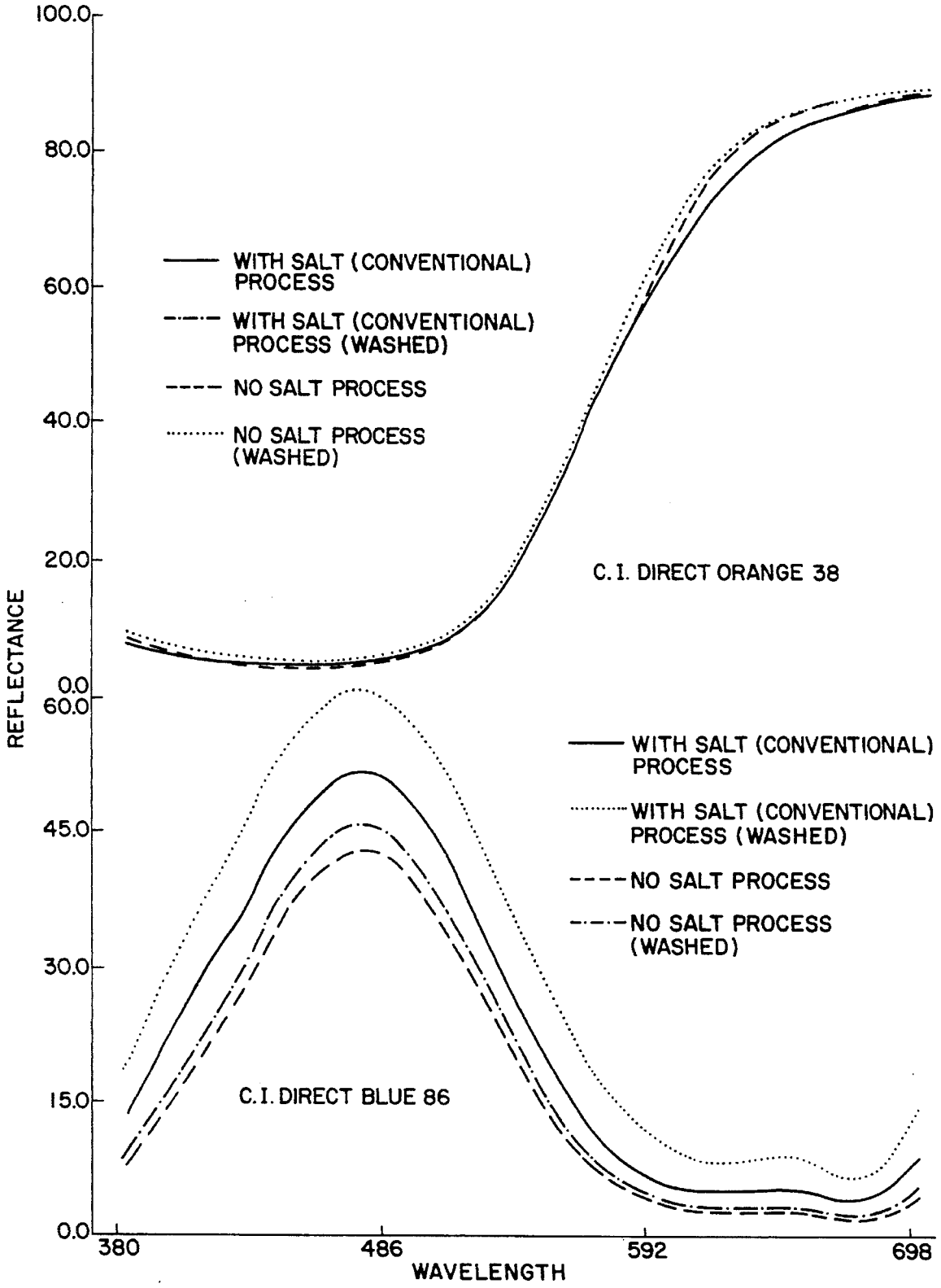
Figure 4:
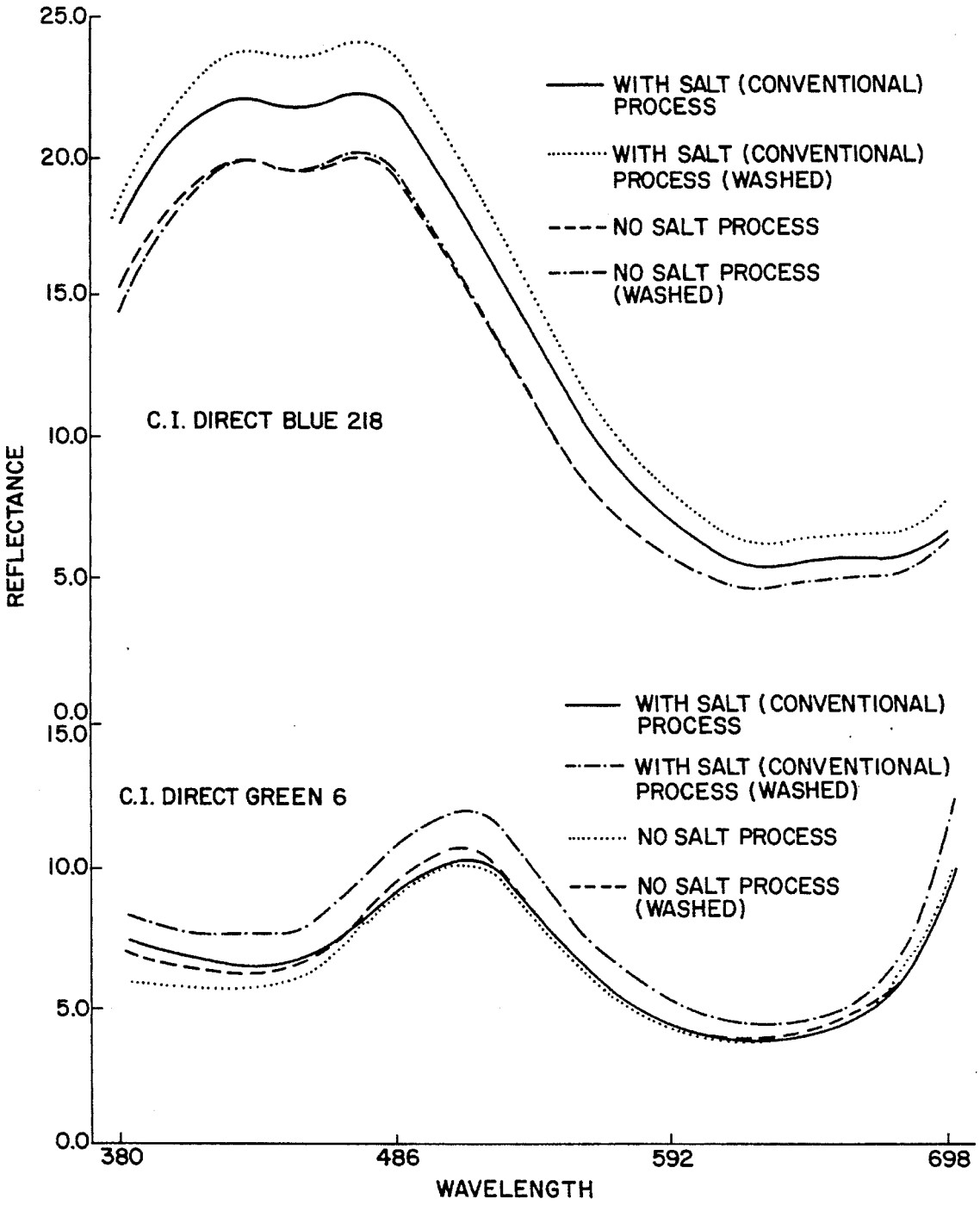

Dyeings were made on a series of Direct dyes using both the no salt procedure of example 1 and the conventional dye manufacturers recommended procedure. The dyes selected were C.I. Direct Blue 86 (3% dyeing using 50% salt owf.), C.I. Direct Blue 218 (1% dyeing and 20% slat owf), C.I. Direct Green 6 (1% dyeing and 20% sal% owf), and C.I. Direct Orange 38 (0.5% dyeing and 15% salt owf). The dyeings were evaluated as in Example 7. In addition, the fabrics were washed using AATCC wash Test #2A [AATCC Test Method 61-1986 "Colorfastness to Laundering, Home and Commercial: Accelerated]. The washed samples were again evaluated for color lass. The results are shown in FIGS. 3–4. With the exception of C.I. Orange 38, all of the dyeings shows a considerable improvement in color yield over the conventional process. Again with the exception of the Orange 38, all of the no salt dyeings (using the procedures in Example 1) show little or no color loss during the laundering process. As a result, the color fastness ratings for the no salt fabrics are superior to those dyed by the conventional process. The Orange fabric, even though it did not show a substantial reduction in color (possibly because of the light 0.5% dyeing), did show heavy staining of the white fabric used in the AATCC test procedure, while the no salt dyed fabric showed very little staining. These tests show that the no salt process gives dyeing superior color yield that have high resistance to removal during laundering.

EXAMPLE 9

In extremely heavy Shades when more dye is being used than that there are dye sites that are made available by the reaction with the epoxypropylammonium salt, additional bleeding of the dye during laundering can occur. In such cases it is often advantageous to use a Dye fixing agent to improve the wetfastness of the dyed goods. Black dyes are notorious for poor wash fastness since heavy shades are normally required to achieve acceptable results. In this experiment Four fabrics were dyed with 3% C.I. Direct Black 22. The dye bath was made up and split into four equal parts. Two fabric samples were dyed using the conventional manufacturers suggested procedure using 40% salt owf. Two samples were dyed on goods that had been prepared and dyed according to the procedures of Example 1. After the dyeings, one set from each dye procedures were laundered using the AATCC wash test #2A. The second set was after treated with a dye fixing agent (3% Amdye DF [American Emulsions Inc., Dalton, Ga.] and the wash fastness determined as above. The results were:

| Fabric Identification | AATCC Wash Test Rating |
|---|---|
| 1. Conventional Dyed Fabric | 2.5 |
| 2. Conventional Dyed/after treated Fabric | 3.5 |
| 3. No salt Dyed Fabric | 3.5 |
| 4. No salt Dyed/after treated Fabric | 4.0 |

The wetfastness of the No salt process is superior to that of the conventional fabric, and is equal to conventional/after treated fabrics. After treatment of the no salt dyed fabrics with a dye fixing agent can improve the wash fastness even further.

It was noted that the no salt dyeing did not build up as good as did the conventional dyeings but they appeared less bronzy. The build up of the shade is better if the potassium hydroxide is used instead of the sodium alkali.

What is claimed is:

1. In a process for dyeing textile fibers or fabrics with a direct or reactive dye which includes the steps of washing and rinsing, the improvement which comprises the steps of a) treating the fibers or fabrics with about 0.5 to 10% by weight solution of sodium hydroxide, b) treating the fibers or fabrics with a solution about 2 to 15% by weight of an epoxy ammonium compound of the formula:

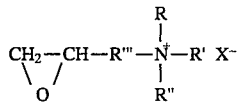

(I)

wherein R, $R^1$ and R" are alkyl radicals having 1 to 8 carbon atoms, R"' is an alkylene radicals having 1 to 8 carbon atoms and $X^-$ is an anionic group selected from the group consisting of sulfate, sulfonate and halide, and c) dyeing the fibers or fabrics in a dye bath without a salt for exhausting the dye in the dye bath at a temperature below 200° F.

2. The process of claim 1 wherein said dye is an acid dye.

3. The process of claim 1 wherein said epoxy ammonium compound is selected from the group consisting of epoxypropyl trimethyl ammonium chloride, epoxypropyl diethylmethyl ammonium sulfate and epoxypropyl dimethyl methyl ammonium iodine.

4. The process of claim 1 wherein said fibers or fabrics are first treated with said sodium hydroxide and second treated with said epoxypropyl ammonium compound.

5. The process claim 1 wherein said fibers or fabrics are treated in a single bath with said sodium hydroxide and said epoxy ammonium compound.

6. The process of claim 1 wherein said dye is black.

* * * * *